US011777202B2

(12) United States Patent
Kim et al.

(10) Patent No.: US 11,777,202 B2
(45) Date of Patent: Oct. 3, 2023

(54) ANTENNA MODULE INCLUDING A FLEXIBLE SUBSTRATE

(71) Applicant: SAMSUNG ELECTRO-MECHANICS CO., LTD., Suwon-si (KR)

(72) Inventors: Young Bal Kim, Suwon-si (KR); Wan Soo Kim, Suwon-si (KR); Sang Hoon Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 18/080,924

(22) Filed: Dec. 14, 2022

(65) Prior Publication Data

US 2023/0163452 A1 May 25, 2023

Related U.S. Application Data

(62) Division of application No. 15/994,723, filed on May 31, 2018, now Pat. No. 11,605,883.

(30) Foreign Application Priority Data

Jul. 28, 2017 (KR) ..... 10-2017-0096446
Sep. 11, 2017 (KR) ..... 10-2017-0115767

(51) Int. Cl.
*H01Q 1/38* (2006.01)
*H01Q 1/24* (2006.01)
(Continued)

(52) U.S. Cl.
CPC ..... *H01Q 1/38* (2013.01); *H01Q 1/2283* (2013.01); *H01Q 1/243* (2013.01); *H01Q 1/248* (2013.01);
(Continued)

(58) Field of Classification Search
CPC .... H01Q 21/062; H01Q 21/061; H01Q 21/28; H01Q 21/08; H01Q 9/285; H01Q 1/248; H01Q 1/243; H01Q 1/2283; H01Q 1/38
See application file for complete search history.

(56) References Cited

U.S. PATENT DOCUMENTS 5,838,412 A 11/1998 Ueda et al.
6,160,526 A 12/2000 Hirai et al.
(Continued)

FOREIGN PATENT DOCUMENTS

CN 1862877 A 11/2006
CN 103493292 A 1/2014
(Continued)

OTHER PUBLICATIONS

Chinese Office Action dated Apr. 3, 2020 in counterpart Chinese Patent Application No. 201810834154.9 (13 pages in English and 7 pages in Korean).
(Continued)

*Primary Examiner* — Graham P Smith
(74) *Attorney, Agent, or Firm* — NSIP Law

(57) ABSTRACT

An antenna module includes an integrated circuit (IC), a substrate having a first region having one or more antenna disposed on a surface thereof and a second region flexibly bent and electrically connected to the IC to provide an electrical connection path to the one or more antenna and the IC, a set substrate electrically connected to the IC, and a set module disposed on the set substrate between the set substrate and the first region.

11 Claims, 8 Drawing Sheets

(51) Int. Cl.

| | |
|---|---|
| ***H01Q 21/08*** | (2006.01) |
| ***H01Q 9/28*** | (2006.01) |
| ***H01Q 1/22*** | (2006.01) |
| ***H01Q 21/28*** | (2006.01) |
| *H01Q 21/06* | (2006.01) |

(52) U.S. Cl.
CPC ..... *H01Q 9/285* (2013.01); *H01Q 21/08* (2013.01); *H01Q 21/28* (2013.01); *H01Q 21/061* (2013.01); *H01Q 21/062* (2013.01)

(56) References Cited

U.S. PATENT DOCUMENTS

| | | | | |
|---|---|---|---|---|
| 2006/0083411 | A1 | 4/2006 | Benkley, III | |
| 2006/0170597 | A1 | 8/2006 | Kurashima et al. | |
| 2009/0289340 | A1 | 11/2009 | Yamazaki et al. | |
| 2009/0289341 | A1 | 11/2009 | Yamazaki et al. | |
| 2012/0056337 | A1 | 3/2012 | Shiroki et al. | |
| 2012/0223866 | A1 | 9/2012 | Ayla Vazquez et al. | |
| 2012/0235881 | A1 | 9/2012 | Pan et al. | |
| 2012/0326931 | A1 | 12/2012 | Murayama et al. | |
| 2015/0084822 | A1* | 3/2015 | Kato ..... | H05K 1/025 343/788 |
| 2016/0049723 | A1 | 2/2016 | Baks et al. | |
| 2017/0079135 | A1 | 3/2017 | Hu et al. | |
| 2017/0150891 | A1 | 6/2017 | Tsuchimoto et al. | |
| 2017/0207524 | A1 | 7/2017 | Cardinali et al. | |

FOREIGN PATENT DOCUMENTS

| | | | |
|---|---|---|---|
| CN | 205830137 | U | 12/2016 |
| CN | 206301938 | U | 7/2017 |
| JP | 5054820 | B2 | 10/2012 |
| JP | 5519716 | B2 | 6/2014 |
| KR | 10-2013-0122688 | A | 11/2013 |
| WO | WO 2009/029520 | A1 | 3/2009 |
| WO | WO 2012/125774 | A2 | 9/2012 |

OTHER PUBLICATIONS

Chinese Office Action dated Dec. 9, 2020 in counterpart Chinese Patent Application No. 201810834154.9 (13 pages in English and 7 pages in Chinese).

Chinese Notice of Allowance dated May 31, 2021 in counterpart Chinese Patent Application No. 201810834154.9 (4 pages in English, 4 pages in Chinese).

* cited by examiner

ANTENNA MODULE INCLUDING A FLEXIBLE SUBSTRATE

CROSS-REFERENCE TO RELATED APPLICATIONS

This application is a Divisional Application of U.S. patent application Ser. No. 15/994,723, filed on May 31, 2018, now U.S. Pat. No. 11,605,883, which claims the benefit under 35 USC 119(a) of Korean Patent Application Nos. 10-2017-0096446 filed on Jul. 28, 2017, and 10-2017-0115767 filed on Sep. 11, 2017, in the Korean Intellectual Property Office, the entire disclosures of which are incorporated herein by reference for all purposes.

BACKGROUND

1. Field

This application relates to an antenna module including a flexible substrate.

2. Description of the Background

Recently, millimeter wave (mmWave) communications including fifth generation (5G) communications are being actively studied, and research into the commercialization of a radio frequency (RF) module able to smoothly implement millimeter wave communications is being actively undertaken.

Since millimeter wave communications use a high frequency, a high level of antenna performance has been required. An antenna satisfying the antenna performance requirement may have a large size, which may hinder miniaturization of the antenna module.

The above information is presented as background information only to assist with an understanding of the present disclosure. No determination has been made, and no assertion is made, as to whether any of the above might be applicable as prior art with regard to the disclosure.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna module includes an integrated circuit (IC), a first substrate having a first region having one or more first antenna disposed on a surface thereof and a second region flexibly bent and electrically connected to the IC to provide an electrical connection path to the one or more first antenna and the IC, a set substrate electrically connected to the IC, and a set module disposed on the set substrate between the set substrate and the first region.

The antenna module may further include a rigid substrate connected to the second region and disposed on the set substrate. The IC may be disposed on the rigid substrate.

The antenna module may further include an electronic component disposed on one surface or the other surface of the second region. The IC may be disposed on the one surface or the other surface of the second region and electrically connected to the electronic component.

The set module may be configured to generate a signal. The set substrate may be configured to transmit the signal to the IC. The IC may be configured to convert the signal into a radio frequency (RF) signal in a millimeter wave (mmWave) band.

The set module may include a DC-DC converter configured to generate power, and the set substrate may be configured to transmit the power to the IC.

At least one of the one or more first antenna may include a patch antenna, and a width of the first region may be greater than that of the second region.

The at least one first antenna may be disposed in an n by n array, where n is a natural number of 2 or more.

The antenna module may further include one or more second antenna disposed on the surface of the first region. The one or more second antenna may include one or more of a dipole antenna and a monopole antenna.

The antenna module may further include a second substrate including a third region including one or more second antenna disposed on a surface thereof and a fourth region flexibly bent and electrically connected to the IC to provide an electrical connection path to the one or more second antenna and the IC.

In another general aspect, an antenna module includes a connector connected to an integrated circuit (IC) configured to generate a radio frequency (RF) signal, a substrate having a first region having one or more antenna disposed on a surface thereof and a second region flexibly bent and electrically connected to the connector to provide an electrical connection path to the one or more antenna and the connector; a set substrate electrically connected to the connector; and a set module disposed on the set substrate between the set substrate and the first region.

The RF signal may include a frequency in a millimeter wave (mmWave) band. The set module may be configured to generate a signal comprising a frequency lower than a frequency of the RF signal. The set substrate may be configured to transmit the signal generated by the set module to the connector.

The set module may include a DC-DC converter configured to generate power. The set substrate may be configured to transmit the power to the connector.

The one or more antenna may include patch antennas disposed in an n by n array, where n is a natural number of 2 or more. A width of the first region may be greater than that of the second region.

In another general aspect, an antenna module includes a substrate including a first region connected to a flexibly bent second region, one or more first antennas and one or more second antennas disposed on the first region, and an integrated circuit (IC), spaced apart from the first region, connected to the second region and electrically connected to the one or more first antennas and the one or more second antennas.

The antenna module may further include a fold between the one or more first antennas and the one or more second antennas.

The antenna module may further include a set module disposed in a concave space of the flexibly bent second region and the folded first region.

The antenna module may further include a set substrate. The set module may be disposed on the set substrate.

The one or more first antenna may include a patch antenna and the one or more second antenna may include one or more of a dipole antenna and a monopole antenna.

The first region may include a rigid portion, the second region may include a flexible portion and the IC may be disposed on a rigid substrate.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

An aspect of the present disclosure provides an antenna module including a flexible substrate having a structure which may be easily miniaturized.

Figure 1:
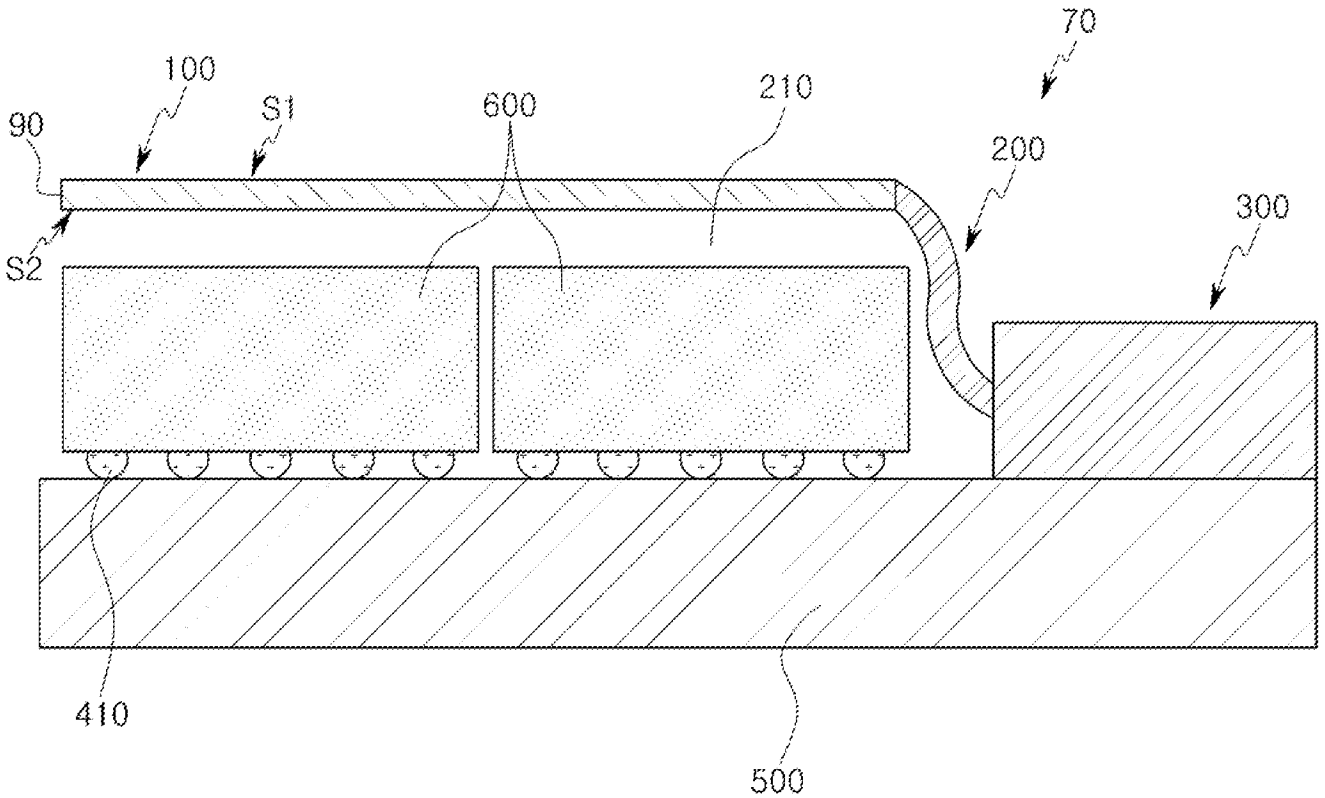
FIG. 1 is a side view illustrating an example of an antenna module including a flexible substrate according to a first embodiment.

FIG. 1 is a side view illustrating an example of an antenna module including a flexible substrate according to a first embodiment.

Referring to FIG. 1, the antenna module 70 includes a substrate 90. The substrate 90 includes a first region 100, a second region 200, and an integrated circuit (IC) 300. The substrate 90 may be a flexible substrate or a rigid-flexible substrate.

The flexible substrate is not particularly limited and may include a material such as paper, polymer, such as polyimide, TEFLON®, etc., the rigid-flexible substrate is not particularly limited and may include a flexible portion composed of a material such as paper, rubber, polymer, such as polyimide, TEFLON®, etc. and a rigid portion composed of a material such as semiconductor, glass, metal, ceramic, composite, rigid polymer, etc., for example, the rigid portion has a structure of a printed circuit board (PCB).

An antenna (described later with reference to FIG. 2) configured to receive a radio frequency (RF) signal and/or transmit an RF signal generated by the IC 300 may be disposed on the first region 100 of the substrate 90. The first region 100 of the substrate 90 provides an electrical path between the IC 300 and the antenna.

The second region 200 of the substrate 90 is electrically connected to the IC 300, flexibly bent, and provides the electrical path between the IC 300 and the antenna.

When the substrate 90 is the rigid-flexible substrate, the first region 100 of the substrate 90 may have a rigid property and the second region 200 of the substrate 90 may have a flexible property.

The substrate 90 has an upper surface 51 and a lower surface S2 in FIG. 1. According to a curved shape of the second region 200 of the substrate 90, a space 210 on the lower surface S2 of the first region 100 of the substrate 90 is secured. For example, the space 210 is covered and protected by the first region 100 so that an element may be securely disposed in the space 210 and the antenna module 70 having the flexible substrate according to the illustrated example of the first embodiment can be miniaturized.

For example, a set module 600 or an electronic device disposed on a set substrate 500 is disposed in the space through a solder ball 410 or similar coupling.

The IC 300 is configured to generate the RF signal and/or receive the RF signal received through the antenna. For example, the IC 300 receives a low frequency signal through the set module 600, and performs at least some of a frequency conversion, amplification, a filtering phase control, and a power generation on the low frequency signal.

For example, the IC 300 can be electrically connected to the set substrate 500 through a solder ball and stably disposed on the set substrate 500 through a resin.

The set module 600 is disposed on the set substrate 500. The set substrate 500 provides an electrical path between the set module 600 and the IC 300.

The set module 600 is configured to generate the low frequency signal, power, and/or at least some of the resistance value, the capacitance, and the inductance provided to the IC 300.

For example, the set module 600 includes a circuit configured to perform amplification, filtering, a frequency conversion, and an analog-to-digital conversion on a baseband signal or an intermediate frequency (IF) signal and includes a DC-DC converter configured to generate power. Here, the IC 300 receives a signal, which is amplified, filtered and/or converted by the set module 600, through the set substrate 500, and converts the received signal into the RF signal in a millimeter wave (mmWave) band.

Figure 2:
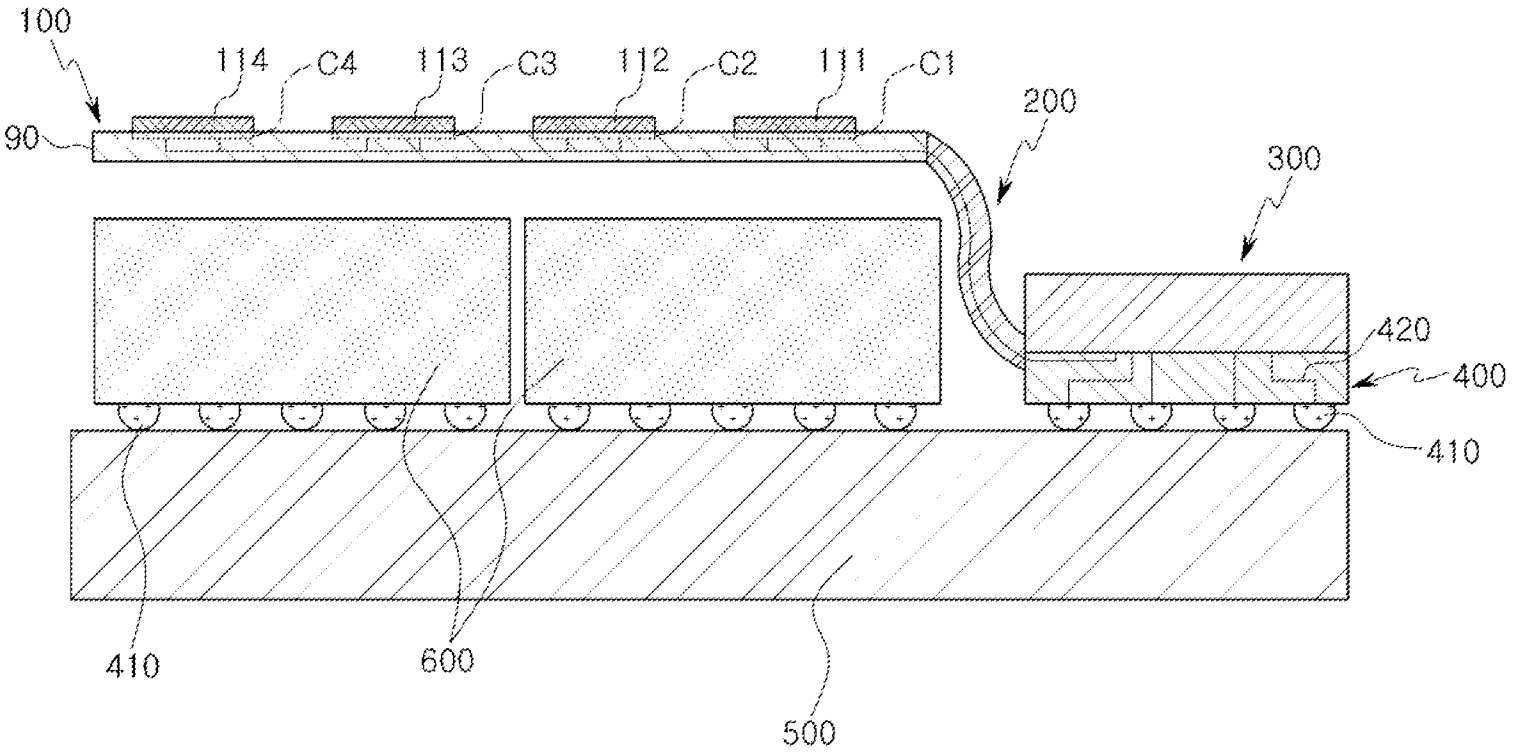
FIG. 2 is a side view illustrating an example of additional detail of the first embodiment of the antenna module including the flexible substrate of FIG. 1.

FIG. 2 is a side view illustrating an example of additional detail the first embodiment of the antenna module including the flexible substrate of FIG. 1.

Referring to FIG. 2, the first region 100 of the substrate 90 includes feed lines 420 and cavities C1, C2, C3, and C4, and the antennas 111, 112, 113, and 114 are disposed on the upper surface 51 of the first region 100 of the substrate 90.

The feed lines 420 each electrically connect the corresponding antennas 114, 113, 112, 111 to the IC 300.

The cavities C1, C2, C3, and C4 provide the boundary condition for the operation of transmitting and/or receiving (hereinafter transmitting/receiving) the RF signal of the corresponding antennas 111, 112, 113, 114. For example, the boundaries of the cavities C1, C2, C3, and C4 are surrounded by a ground layer, a plating layer, or a via, and the ground layer is not substantially disposed inside the cavities C1, C2, C3, and C4.

Alternatively, the cavities C1, C2, C3, and C4 may be omitted depending on the type of the corresponding antennas 111, 112, 113, 114. For example, the cavities C1, C2, C3, and C4 are not formed in a region where a dipole antenna or a monopole antenna is disposed in the first region 100 of the substrate 90.

Referring to FIG. 2, the IC 300 is disposed on a rigid substrate 400 where the second region 200 of the substrate 90 is connected to a side surface of the IC 300. The rigid substrate 400 may be composed of a material such as semiconductor, glass, metal, ceramic, composite, rigid polymer, etc., for example, the rigid portion has a structure of a printed circuit board (PCB).

The rigid substrate 400 includes the feed lines 420 and is disposed on the set substrate 500 through a solder ball 410 or similar coupling.

For example, the rigid substrate 400 has the same structure as a printed circuit board (PCB), and has a circuit pattern region that provides a ground region and/or a power supply region that supplies power to the IC 300.

The first and second regions 100 and 200 of the substrate 90 have the structure of the rigid-flexible substrate together with the rigid substrate 400.

Figure 3:
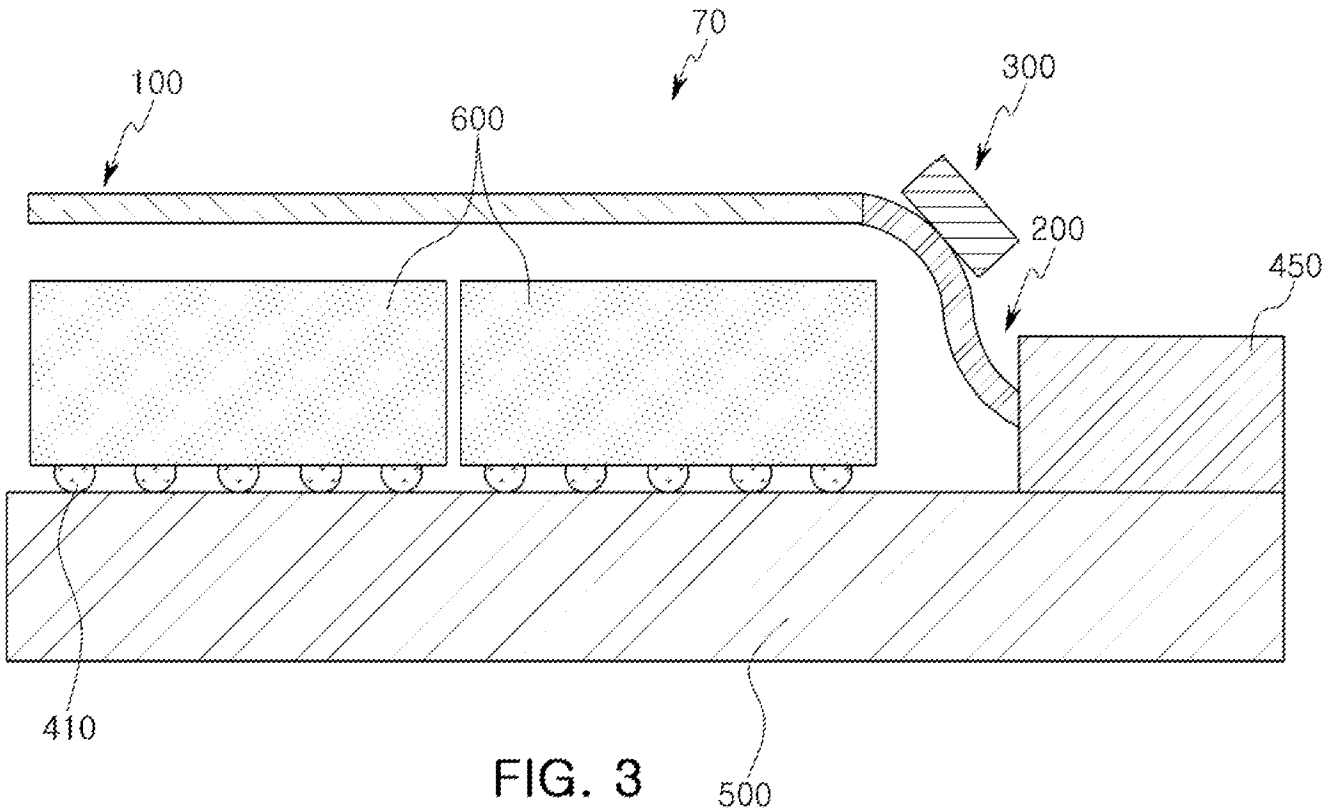
FIG. 3 is a side view illustrating an example of a form in which an integrated circuit (IC) is disposed on a flexible substrate in an example of an antenna module according to a second embodiment.

FIG. 3 is a side view illustrating an example of a form in which an IC is disposed on a flexible substrate in an example of an antenna module 70 according to a second embodiment.

Referring to FIG. 3, the IC 300 is disposed on the second region 200 of the substrate 90.

The second region 200 of the substrate 90 is connected to a connector 450 disposed on the set substrate 500. The connector 450 has a connector shape to be coupled to an outside, another module, or another substrate in a wired manner, and may be configured to be electromagnetically coupled to an outside, another module, or another substrate.

Figure 4:
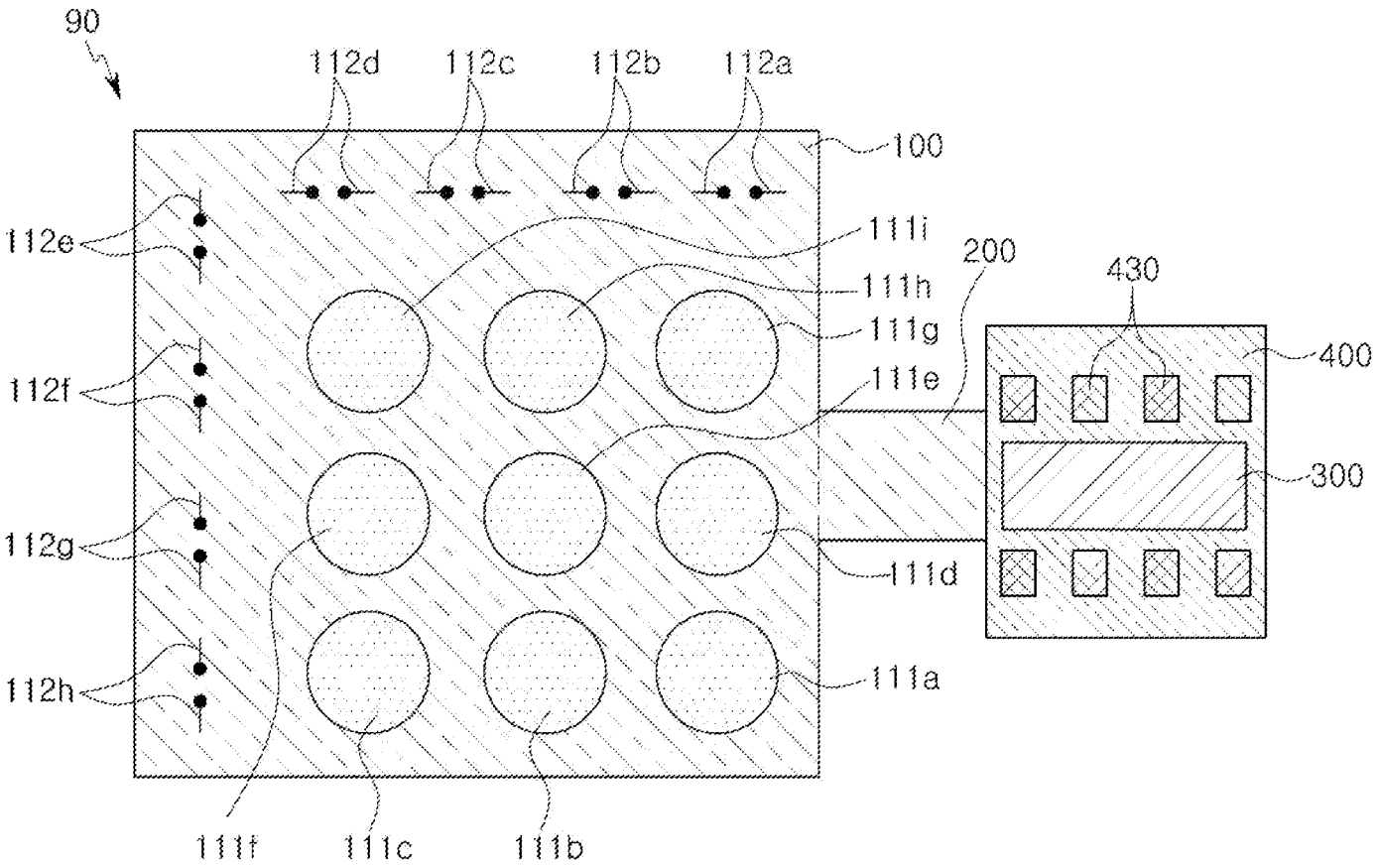
FIG. 4 is a plan view illustrating an example of a first form of the IC arrangement on an antenna module including the flexible substrate according to a third embodiment.

FIG. 4 is a plan view illustrating an example of a first form of the IC arrangement of the antenna module including the flexible substrate according to a third embodiment.

Referring to FIG. 4, first antennas 111*a*, 111*b*, 111*c*, 111*d*, 111*e*, 111*f*, 111*g*, 111*h*, and 111*i* have the structure of a patch antenna and are disposed on the first region 100 of the substrate 90, and second antennas 112*a*, 112*b*, 112*c*, 112*d*, 112*e*, 112*f*, 112*g*, and 112*h* have the structure of a dipole antenna or a monopole antenna and are also disposed on the first region 100 of the substrate 90.

Referring to FIG. 4, the IC 300 and an electronic component 430 are disposed on the rigid substrate 400.

An electronic component 430 provides at least some of a resistance value, capacitance, and inductance to the IC 300. For example, the electronic component 430 includes a multilayer ceramic capacitor (MLCC).

The first region 100 of the substrate 90 may be folded between a patch region where the patch antennas are disposed and a pole region where the dipole antennas and/or monopole antennas are disposed.

Figure 5:
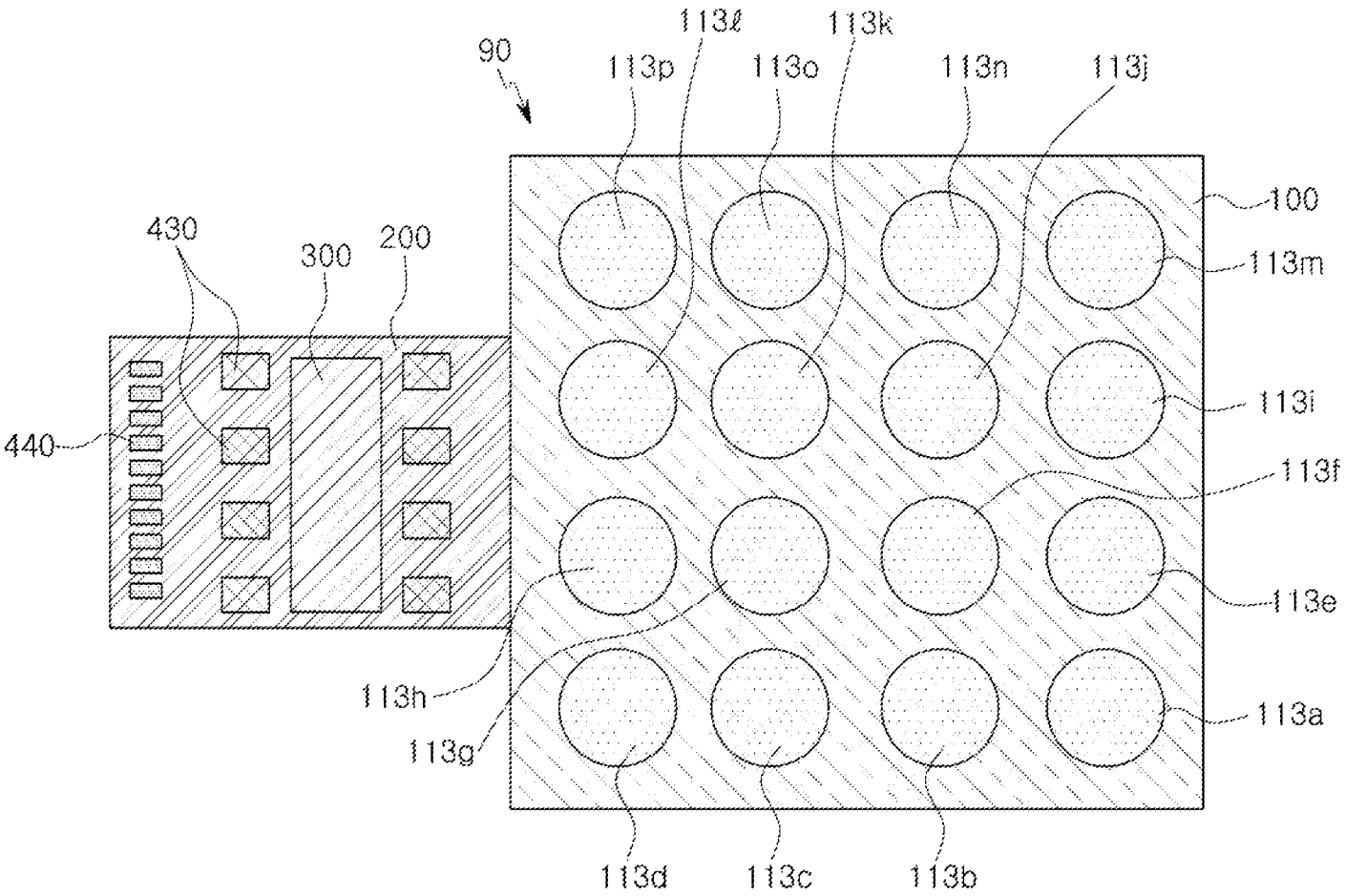
FIG. 5 is a plan view illustrating an example of a second form of the IC arrangement on the antenna module including the flexible substrate according to a fourth embodiment.

FIG. 5 is a plan view illustrating an example of a second form of the IC arrangement of the antenna module including the flexible substrate according to a fourth embodiment.

Referring to FIG. 5, antennas 113*a*, 113*b*, 113*c*, 113*d*, 113*e*, 113*f*, 113*g*, 113*h*, 113*i*, 113*j*, 113*k*, 113*l*, 113*m*, 113*n*, 113*o*, and 113*p* have the structure of the patch antenna, and are disposed on the first region 100 of the substrate 90. The patch antennas may have a circular shape, a polygonal shape, or a combination thereof, but the shape of the patch antennas is not particularly limited.

Referring to FIG. 5, the IC 300, the electronic component 430, and an interface pad 440 are disposed on an upper surface of the second region 200. However, the IC 300, the electronic component 430, and the interface pad 440 may be disposed on the lower surface or both the upper and lower surfaces of the second region 200 of the substrate 90.

The interface pad 440 is electrically connected to the connector 450 illustrated in FIG. 3.

Figure 6:
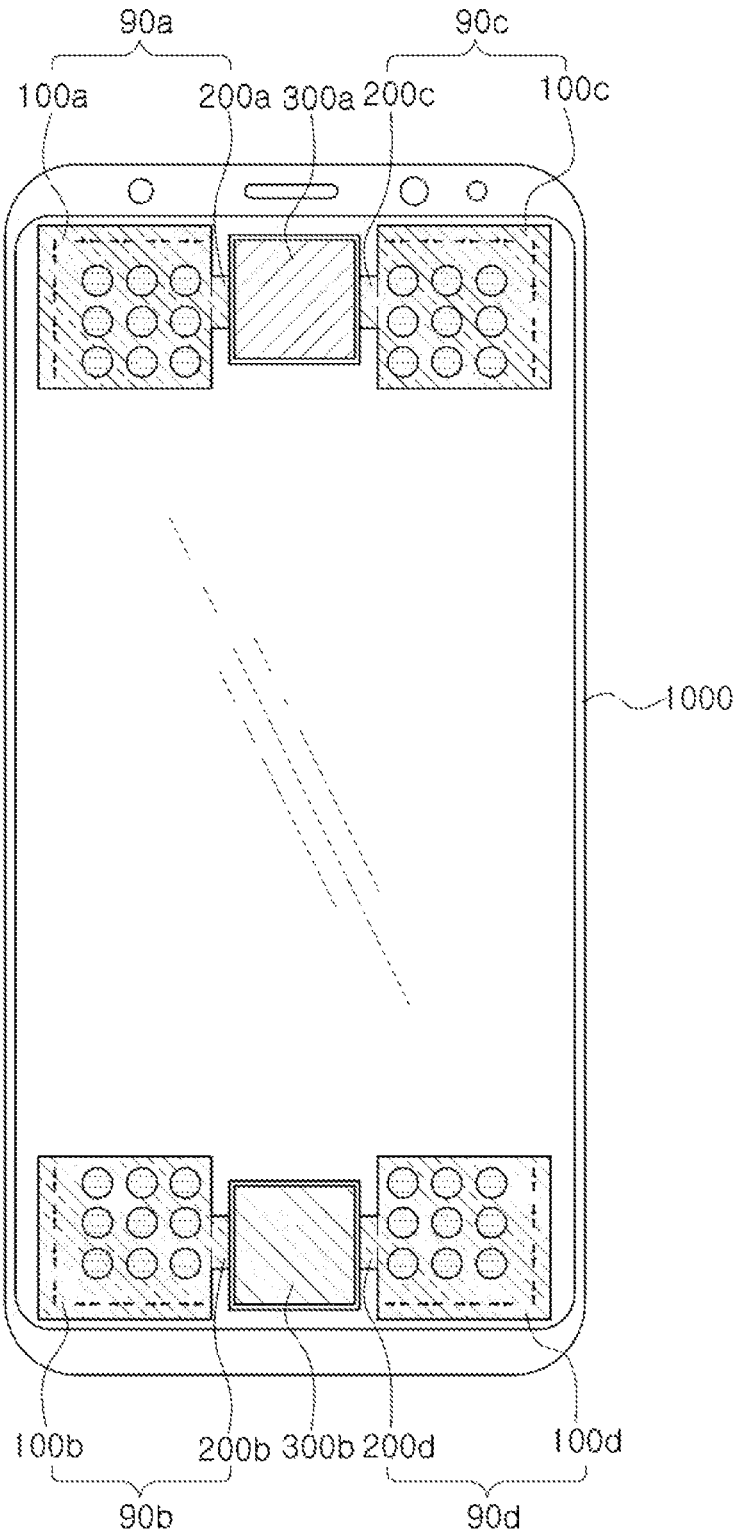
FIG. 6 is a plan view illustrating an example form in which an antenna module including the flexible substrate according to a fifth embodiment is applied to an electronic device.

FIG. 6 is a plan view illustrating an example form in which the antenna module including the flexible substrate according to a fifth embodiment is applied to an electronic device.

Referring to FIG. 6, an electronic device 1000 includes first regions 100*a*, 100*b* of first substrates 90*a*, 90*b*, second regions 200*a*, 200*b* of the first substrates 90*a*, 90*b*, third regions 100*c*, 100*d* of second substrates 90*c*, 90*d*, fourth regions 200*c*, 200*d* of the second substrates 90*c*, 90*d*, and ICs 300*a* and 300*b*.

Figure 7:
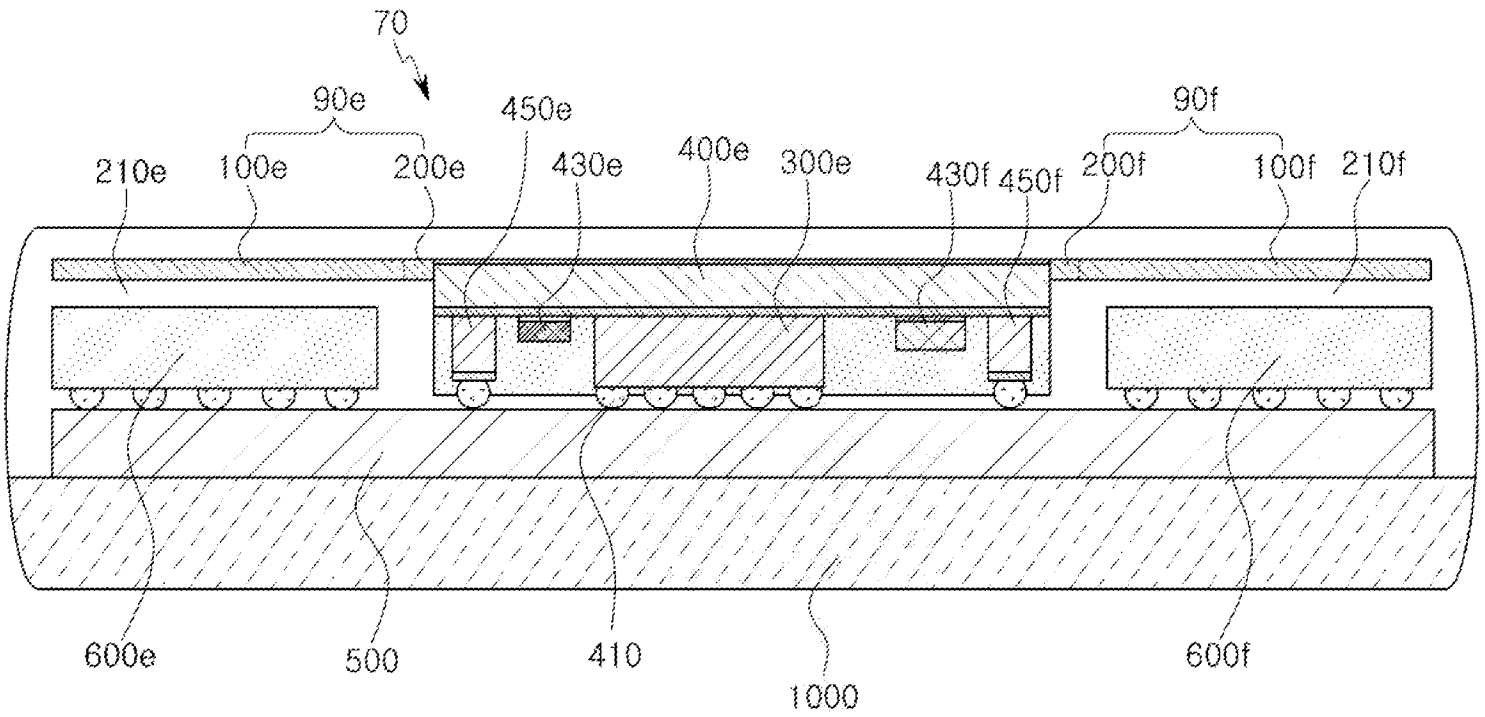
FIG. 7 is a side view illustrating an example form in which an antenna module including the flexible substrate according to a sixth embodiment is applied to an electronic device.

FIG. 7 is a side view illustrating an example form in which the antenna module including the flexible substrate according to a sixth embodiment is applied to an electronic device.

Referring to FIG. 7, the antenna module 70 including the flexible substrate according to the sixth embodiment includes a first region 100*e* of a first substrate 90*e*, a second region 200*e* of the first substrate 90*e*, a third region 100*f* of a second substrate 90*f*, a fourth region 200*f* of the second substrate 90*f*, and an IC 300*e*.

The IC 300*e* is disposed between a rigid substrate 400*e* and a set substrate 500.

Electronic components 430*e* and 430*f* and connectors 450*e* and 450*f* are disposed on the rigid substrate 400*e*.

The connectors 450*e* and 450*f* and the IC 300*e* are electrically connected to the set substrate 500 through the solder ball 410.

For example, the connectors 450*e* and 450*f*, the IC 300*e*, and the electronic components 430*e* and 430*f* are surrounded by an epoxy molding compound (EMC) to be protected from an external environment. In another example, the epoxy molding compound is omitted, for example, for reasons such as the ambient environment of the antenna module.

First and second set modules 600*e* and 600*f* are disposed on the set substrate 500. The first set module 600*e* is disposed in a first space 210*e* below the first region 100*e* of the first substrate 90*e* and the second set module 600*f* is disposed in a second space 210*f* below the third region 100*f* of the second substrate 90*f*. That is, the first and third regions 100*e* and 100*f* secure respective first and second spaces 210*e* and 210*f* for arrangement of the first and second set modules

600*e* and 600*f* below lower surfaces while providing arrangement space of the antennas on upper surfaces.

When the respective first and second spaces 210*e* and 210*f* of the set modules 600*e* and 600*f* are large, some of the operations performed by the IC 300*e* may be instead performed by the set modules 600*e* and 600*f*, and the influence of heat and/or noise and the like generated due to the operation of the set modules 600*e* and 600*f* on the IC 300*e* or the antenna may also be reduced.

That is, the example of the antenna module including the flexible substrate according to the sixth embodiment of the present disclosure may not only have a structure that is easily miniaturized, but may also improve the performance of the antenna.

Figure 8:
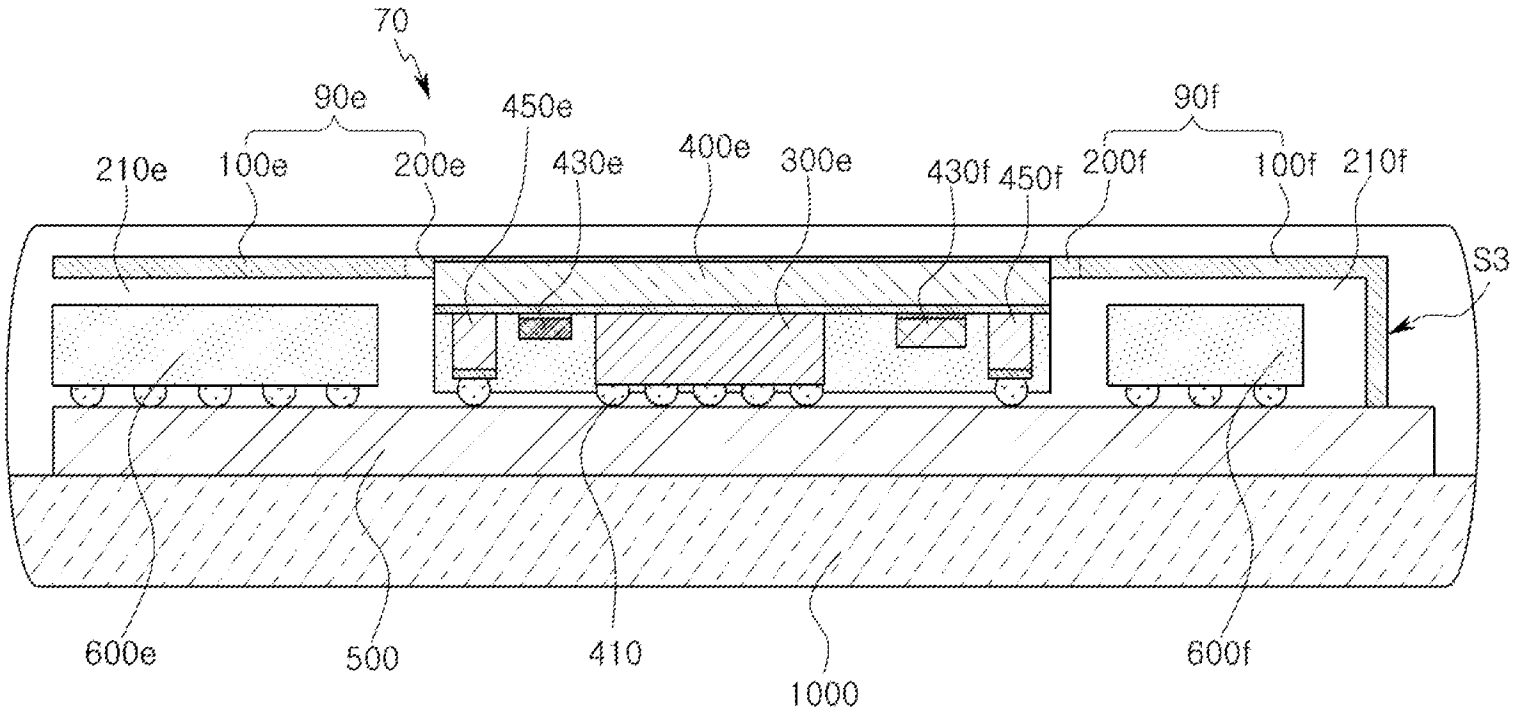
FIG. 8 is a side view illustrating an example form in which an antenna module including the flexible substrate according to a seventh embodiment is applied to an electronic device.

In a seventh embodiment of the antenna module 70, when the set modules 600*e* and 600*f* are not disposed in at least a part of the first and/or second space 210*e*, 210*f* provided by the first and third regions 100*e* and 100*f*, one or more surface S3 of the first and third regions 100*e* and 100*f* faces the side direction of the electronic device 1000, for example, as illustrated in FIG. 8. Accordingly, the transmission and/or reception direction of the antenna may be enlarged.

As set forth above, according to the first through seventh illustrated embodiments of the present disclosure, the antenna module including the flexible substrate, for example, has a structure that is easily miniaturized.

In addition, the antenna module including a flexible substrate, for example, enlarges the transmission and/or reception direction of the antenna.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna module, comprising:

a connector connected to an integrated circuit (IC) configured to generate a radio frequency (RF) signal;

a substrate comprising a first region comprising one or more antenna disposed on a surface thereof and a second region flexibly bent and electrically connected to the connector to provide an electrical connection path to the one or more antenna and the connector, wherein the first region is directly connected to the second region;

a set substrate electrically connected to the connector; and a set module disposed on the set substrate between the set substrate and the first region.

2. The antenna module of claim 1, wherein the RF signal comprises a frequency in a millimeter wave (mmWave) band, wherein the set module is configured to generate a signal comprising a frequency lower than a frequency of the RF signal, and wherein the set substrate is configured to transmit the signal generated by the set module to the connector.

3. The antenna module of claim 1, wherein the set module comprises a DC-DC converter configured to generate power, and wherein the set substrate is configured to transmit the power to the connector.

4. An antenna module, comprising:

a connector connected to an integrated circuit (IC) configured to generate a radio frequency (RF) signal;

a substrate comprising a first region comprising one or more antenna disposed on a surface thereof and a second region flexibly bent and electrically connected to the connector to provide an electrical connection path to the one or more antenna and the connector;

a set substrate electrically connected to the connector; and a set module disposed on the set substrate between the set substrate and the first region, wherein the one or more antenna comprises patch antennas disposed in an n by n array, where n is a natural number of 2 or more, and wherein a width of the first region is greater than a width of the second region.

5. An antenna module, comprising:

a substrate comprising a first region connected to a flexibly bent second region;

one or more first antennas and one or more second antennas disposed on the first region; and an integrated circuit (IC), spaced apart from the first region, connected to the second region and electrically connected to the one or more first antennas and the one or more second antennas.

6. The antenna module of claim 5, further comprising a fold between the one or more first antennas and the one or more second antennas.

7. The antenna module of claim 6, further comprising a set module disposed in a concave space of the flexibly bent second region and the folded first region.

8. The antenna module of claim 7, further comprising a set substrate, wherein the set module is disposed on the set substrate.

9. The antenna module of claim 8, wherein the set module is configured to generate a signal, wherein the set substrate is configured to transmit the signal to the IC, and wherein the IC is configured to convert the signal into a radio frequency (RF) signal in a millimeter wave (mmWave) band.

10. The antenna module of claim 5, wherein the one or more first antenna comprises a patch antenna and the one or more second antenna comprises one or more of a dipole antenna and a monopole antenna.

11. The antenna module of claim 5, wherein the first region comprises a rigid portion, the second region comprises a flexible portion and the IC is disposed on a rigid substrate.

* * * * *